United States Patent [19]

Dankowski

[11] 4,345,644

[45] Aug. 24, 1982

[54] OIL COOLER

[76] Inventor: Detlef B. Dankowski, 921 Westbrook, Garland, Tex. 75043

[21] Appl. No.: 203,135

[22] Filed: Nov. 3, 1980

[51] Int. Cl.[3] ..... F28F 1/42; F28F 9/22

[52] U.S. Cl. ..... 165/154; 165/170; 165/179; 165/DIG. 23

[58] Field of Search ..... 165/154, 155, 169, 179, 165/170, 141, DIG. 23; 184/104 B; 123/196 A, 196 B, 41.33

[56] References Cited

U.S. PATENT DOCUMENTS

| | | | |
|---|---|---|---|
| 1,519,673 | 12/1924 | Doble | 165/179 X |
| 1,580,974 | 4/1926 | Rembold | 165/141 |
| 1,983,466 | 12/1934 | Kline | 165/154 |
| 2,242,316 | 5/1941 | McCollum | 165/172 |
| 2,356,779 | 8/1944 | Morrison | 165/154 |
| 2,368,732 | 2/1945 | Wallgren | 165/122 X |
| 2,432,308 | 12/1947 | Goodyer | 165/179 |
| 2,577,188 | 12/1951 | Hall | 184/104 B |
| 2,610,478 | 9/1952 | Lofstedt | 165/154 |
| 2,661,934 | 12/1953 | Stutz | 165/154 |
| 3,127,530 | 3/1964 | White | 165/46 X |
| 3,335,789 | 8/1967 | Raskin | 165/169 X |
| 3,446,278 | 5/1969 | Heinrich | 165/155 |
| 3,991,822 | 11/1976 | Morris | 165/169 |

FOREIGN PATENT DOCUMENTS

| | | | |
|---|---|---|---|
| 37440 | 10/1886 | Fed. Rep. of Germany | 165/155 |
| 78856 | 12/1893 | Fed. Rep. of Germany | 165/155 |
| 646866 | 6/1937 | Fed. Rep. of Germany | 165/169 |
| 652536 | 3/1929 | France | 165/169 |
| 1286008 | 12/1962 | France | 165/155 |
| 339870 | 12/1930 | United Kingdom | 165/155 |

*Primary Examiner*—Sheldon J. Richter

*Attorney, Agent, or Firm*—Richards, Harris & Medlock

[57] ABSTRACT

The present invention relates to a heat exchange unit for cooling oil or other fluids.

14 Claims, 6 Drawing Figures

OIL COOLER

BACKGROUND ART

Oil used as a lubricant in engines or as a prime mover in fluid drive units must be cooled to avoid overheating. Oil coolers used to maintain an acceptable oil temperature level have normally been of the tube and fin radiator type. The design of these units normally includes a flow path defined by tubing formed into a tortuous path having a multitude of fins pressed thereon in heat exchange relation. The oil, upon flowing through the tubing, is cooled as a result of heat exchange with the surrounding atmosphere. While these radiators provide effective heat exchange for oil or other fluids, they are expensive to produce and, at times, are difficult to repair when a leak develops therein.

Core-type oil coolers have also been used. Such an oil cooler is disclosed in U.S. Pat. No. 1,983,466 to J. E. Kline, issued Dec. 4, 1934. In the oil cooler disclosed in the Kline patent, an inner core is mounted concentrically within an outer cylindrical shell. A series of annular baffles are arranged between the core and the shell with a portion of each baffle being cut away to form a port. The ports of alternate baffles are arranged at diametrically opposed sides of the cooler such that oil is made to flow along upward and downward paths between the baffles as the fluid moves from an inlet pipe through the cooler to an exit pipe.

Although such oil coolers have provided an alternative to the fin-type radiator units, these coolers are also expensive and have been somewhat insufficient in the degree of heat exchange provided. Therefore, a need has arisen for a fluid cooler which is both economical to produce and is effective in providing a heat exchange relationship between the fluid and the surrounding atmosphere.

DISCLOSURE OF INVENTION

The present invention provides an improved fluid cooler which overcomes many of the disadvantages heretofore experienced by prior art units. In one embodiment of the invention, the fluid cooler includes a body having a circuitous path extending therethrough. The path is formed by a plurality of passageways, including an inlet passageway and an exhaust passageway, extending longitudinally through a main body. A cap is mounted on opposite ends of the body and connects the alternate ends of the passageways to form a single continuous flow path through the body from the inlet passageway to the exhaust passageway.

The passageways are arranged circumferentially with the exhaust passageway being at one end of the circumferential arrangement and the inlet passageway being on the opposite end. The arrangement of passageways defines a center air passageway. An inlet communicates with the inlet passageway for introducing fluid into the inlet passageway and an outlet communicates with the exhaust passageway to permit exhaust of fluid from the body.

In a more specific embodiment of the invention, the inlet passageway is spaced from the exhaust passageway to provide an air gap therebetween. Heat exchange fins extend into the passageways and exteriorly of the passageway to provide for heat transfer from the fluid to the surrounding atmosphere.

In the primary embodiment of the invention, the body is a longitudinal extrusion having a constant cross section along its length. Each end cap includes an end plate for attachment to the extrusion. The caps have channels molded therein for connecting alternate ends of the passageways.

BRIEF DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENTS

Figure 1:
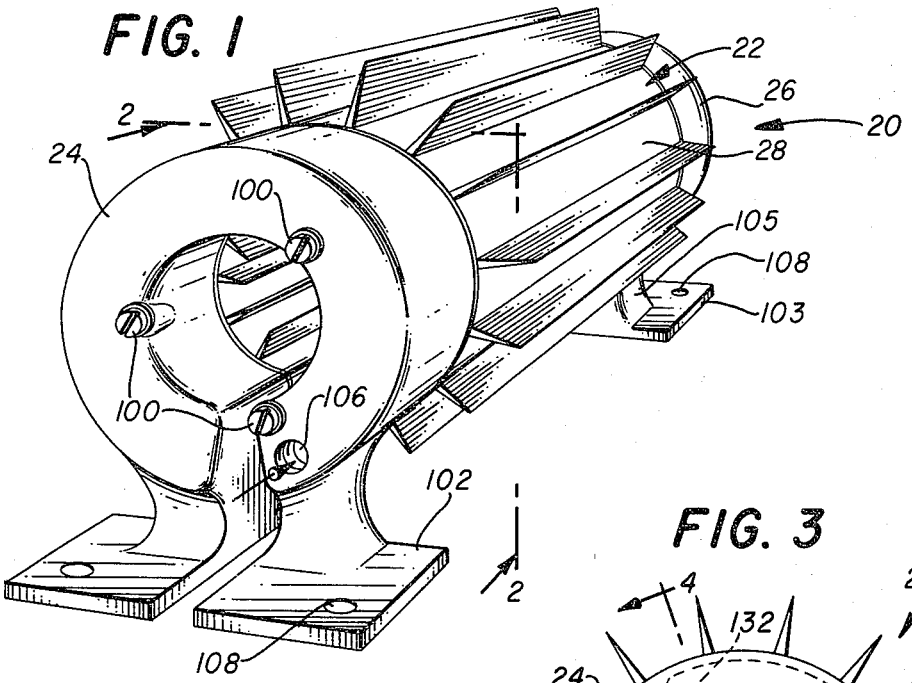
FIG. 1 is a perspective view of the fluid cooler according to the present invention.
Figure 2:
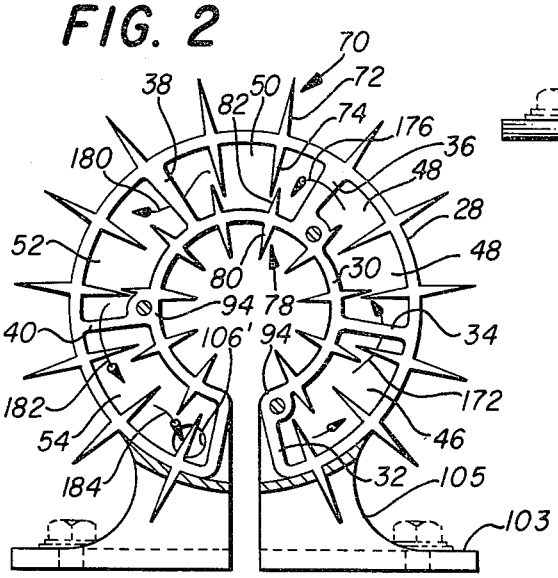
FIG. 2 is a vertical section view taken along lines 2—2 of FIG. 1.

Referring to FIG. 1, the fluid cooler 20 according to the present invention includes a body 22 having end caps 24 and 26 attached to opposite ends thereof. As is seen in FIG. 2, body 22 includes an outer cylindrical wall 28 and an inner substantially concentric cylindrical wall 30 joined by passage walls 32, 34, 36, 38, 40 and 42. An inlet passageway 46 is formed between outer and inner walls 28 and 30, respectively, and passage walls 32 and 34. Intermediate passageway 48 is formed by outer and inner walls 28 and 30, respectively, and passageway walls 34 and 36. Intermediate passageway 50 is formed between outer and inner walls 28 and 30, respectively, and passage walls 36 and 38. Intermediate passageway 52 is formed between outer and inner wall 28 and 30, respectively, and passage walls 38 and 40. An exhaust passageway 54 is formed between outer and inner walls 28 and 30, respectively, and passage walls 40 and 42.

As is seen in both FIGS. 1 and 2, a plurality of heat exchange fins 70 extends from outer walls 28. Fin portions 72 extend outwardly from wall 28 and inner fin portions 74 extend inwardly into the passageways. Similarly, a plurality of fins 78 extends from inner wall 30. Fin portions 80 extend from wall 30 radially outwardly from the passageways and fin portions 82 extend radially into the passageways.

As can be seen in FIG. 2, passageways 46, 48, 50, 52 and 54 are positioned in a circumferential arrangement defining an inner air passageway 90. An air gap 92 is formed between passage wall 32 of passageway 46 and passage wall 42 of passageway 54. A plurality of screw receiving bosses 94 is formed in the interior corner of passageways 46, 48 and 52.

Referring again to FIG. 1, end caps 24 and 26 are attached to body 22 by a plurality of screws 100. The oil cooler is also supported from base pads 102 and 103 connected to end caps 24 and 26 by legs 104 and 105, respectively. An inlet aperture 106 is also formed through end cap 24 and provides for the communication of fluid into passageway 46 (FIG. 2). Holes 108 and 109 are formed in base pads 102, 103, respectively, and are used for mounting the small cooler in a stationary position.

As can be seen in FIGS. 1 and 2, body 22 may be readily extruded from aluminum or other suitable materials and cut to any desired length. Thus, the cooling properties provided by the unit may be easily altered and adapted to various situations by merely varying the length of body 22.

Figure 3:
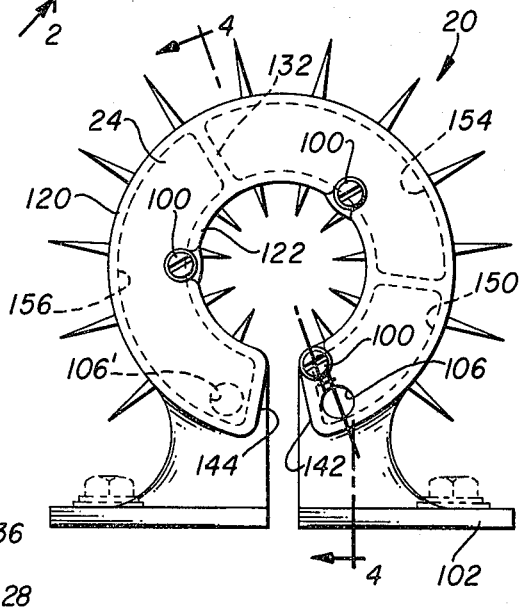
FIG. 3 is an end view of the fluid cooler.
Figure 4:
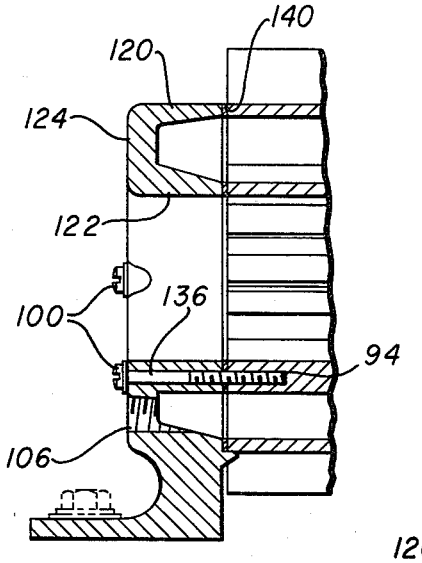
FIG. 4 is a section view taken along lines 4—4 of FIG. 3.

End caps 24 and 26 are identical pieces, therefore making possible the use of a single piece for both end caps used in the present invention. Referring now to FIGS. 3 and 4, end cap 24 includes a cylindrical outer wall 120 and a cylindrical inner wall 122 joined by an end wall 124. As is shown in FIG. 3, walls 130 and 132 are formed between inner wall 122 and outer wall 120 of end cap 24. Walls 142 and 144 extend between inner and outer walls 122 and 120, respectively. Appropriate apertures 136 are formed through end cap 24 to receive screws 100 therethrough for engagement into bosses 94 of body 22.

Referring to FIG. 3, it can be seen that a channel 150 is formed between outer and inner walls 120 and 122, respectively, and wall 130 and end wall 142. A channel 154 is formed in end cap 24 between outer and inner walls 120 and 122, respectively, and walls 130 and 132. A channel 156 is formed in end cap 24 between outer and inner walls 120 and 122, respectively, and walls 132 and 144 of end plate 24.

FIG. 4 illustrates a section view showing end cap 24 attached to body 22 with an appropriate gasket 140 mounted therebetween. With end cap 24 mounted to body 22, wall 130 of end cap 24 is aligned and sealingly engages with wall 34 of body 22. Further, wall 132 of end cap 24 is aligned and sealingly engages with wall 38 of body 22.

Figure 5:
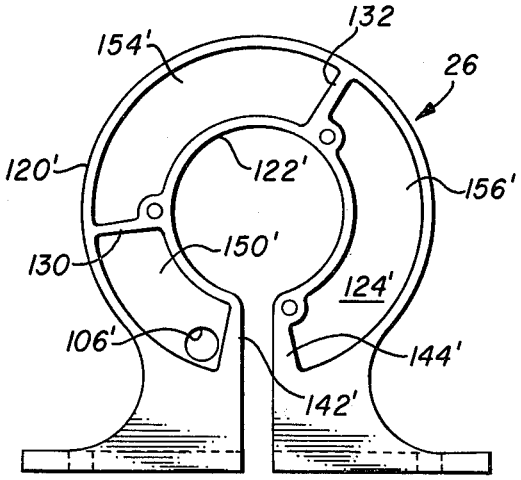
FIG. 5 is a plan view showing end cap 26 removed from body 22.

As can be seen in FIG. 5, end cap 26 is identical to end cap 24 and includes a cylindrical outer wall 120′ and a cylindrical inner wall 122′ joined by an end wall 124′. Walls 130′ and 132′ are formed between inner wall 122′ and outer wall 120′ of end cap 26. Appropriate apertures are formed through end cap 26 to receive screws therethrough for engagement into bosses 94 of body 22. Walls 142′ and 144′ extend between inner and outer walls 122 and 120, respectively.

Referring to FIG. 5, a channel 150′ is formed between outer and inner walls 120′ and 122′, respectively, and walls 30′ and end wall 142′ of cap 26. A channel 154′ is formed in end cap 26 between outer and inner walls 120′ and 122′, respectively, and walls 130′ and 132′. A channel 156′ is formed in end cap 26 between outer and inner walls 120′ and 122′, respectively, and walls 132′ and 144′.

With end cap 26 mounted to body 22, wall 130′ of cap 26 is aligned with and sealingly engages wall 40 of body 22. Wall 132′ of end cap 26 is aligned with and sealingly engages wall 36 of body 22.

With end cap 24 mounted to the opposite ends of body 22, a continuous circuitous flow path is provided from inlet aperture 106 of end cap 24 to the aperture 106′ in end plate 26 mounted to the opposite end of body 22. Apertures 106 and 106′ of end caps 24 and 26 are threaded to receive an appropriate attachment fitting for receiving conduits thereon to deliver fluid to and from the cooler.

Figure 6:
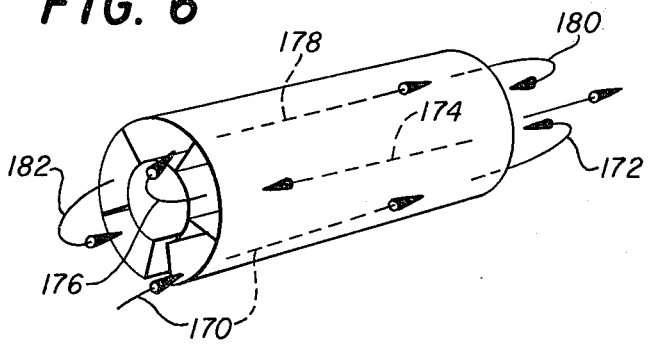
FIG. 6 is a perspective schematic view illustrating the flow path of fluid through the fluid cooler of the present invention.

Referring to FIG. 6, in conjunction with FIGS. 2, 3 and 5, the flow path of fluid introduced into aperture 106 of end cap 24 may be described as follows. The fluid passes through passageway 46 along the path indicated by arrows 170 and is directed by channel 156′ of end cap 26 along the paths indicated by arrow 172 into passageway 48 along the direction of arrow 174. The fluid then confronts channel 154 of end plate 24 and is directed along the path indicated by arrow 176 into passageway 50 along the paths indicated by arrow 178. Fluid then engages channel 154′ of end cap 26 and is directed along the path indicated by arrow 180 to enter passageway 52 of body 22. The fluid then engages channel 156 of end cap 24 following the path indicated by arrow 182 and enters passageway 54. At the end of the fluid's path of travel in passageway 54, the fluid exits along the path indicated by arrow 184 through aperture 106′ of end cap 26.

Fluid passing through the circuitous path just described will be in a heat exchange relation both with air or other cooling fluids passing through the passageway defined by inner wall 122 of body 22 and exteriorly of body 22. This heat exchange is greatly facilitated by the presence of fins 70 and 78 which extend interiorly and exteriorly of the fluid passageways and therefore conduct heat from the fluid to the surrounding medium.

The temperature of the fluid in the system will be hotter in passageway 46 than in any of the succeeding passageways in that heat exchange provided by the system will take place progressively as the fluid flows through the fluid cooler. Likewise, the fluid flowing through passageway 54 and exiting through aperture 106′ of end cap 26 will be the coolest fluid in the system. Thus, by providing an air gap 92 between passageways 46 and 54, a more effective heat exchange is provided in that fluid which is cooled by its passage through the system is not reheated by being in direct heat exchange relation with the fluid just entering the system.

The present fluid cooler may be mounted in any location where heat exchange can take place between the fluid flowing through the system and the surrounding atmosphere. For example, the cooler may be mounted within the engine compartment of an automobile where either engine oil or transmission oil is directed therethrough for cooling. Because of the compactness of the present invention, the system may be mounted in an air flow path such that air may be circulated through the air passageway defined by the circumferential placement of the fluid passageways, as well be circulated exteriorly of these passageways. It will also be appreciated that the present invention may be readily adapted to effect a desired temperature decrease for the fluid being cooled by merely adjusting the length of body 22. Thus, the present invention is readily adaptable to a wide range of applications. Further, the end caps 24 and 26 are identical components mounted on opposite ends of body 22. Therefore, the present system provides an extremely economical system which is composed basically of only a body core and a pair of identical end caps.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A fluid cooler comprising:

a body defining a plurality of circumferentially spaced interconnected passageways, each passageway having a forward and rearward end with alternate ends of said passageways being in fluid communication to provide a continuous circuitous passageway for fluid from a first passageway through intermediate passageways to an exhaust passageway, said first passageway being completely separated from said exhaust passageway by a heat exchange fluid gap;

means for injecting fluid into the first passageway; and a discharge aperture permitting fluid discharge from the exhaust passageway.

2. The cooler according to claim 1 wherein said heat exchange fluid is air.

3. The cooler according to claim 1 further comprising heat exchange fins extending into the passageways and exteriorly of the passageways to provide for heat transfer from the fluid to the surround atmosphere.

4. The cooler according to claim 1 wherein said body is a longitudinal extrusion of constant cross section and wherein said forward and rearward ends comprise identical end plates for attachment to said extrusion for connecting the alternate ends of said passageways.

5. A primary fluid cooler comprising:

a body having a circuitous passageway therethrough, said circuitous passageway being formed by a plurality of passageways, including an inlet passageway and an exhaust passageway, extending longitudinally therethrough and having a cap means connecting the alternate ends of said passageways to form a single continuous flow path through the body from the inlet passageway to the exhaust passageway, said passageways being arranged circumferentially with said exhaust passageway being on one end of said circumferential arrangement and the inlet passageway and being on the end opposite said exhaust passageway, and with a heat exchange fluid gap between and completely separating said inlet and exhaust passageways, said arrangement of said passageways defining a center heat exchange fluid passageway, thereby providing for the flow of a heat exchange fluid on an inner and outer side of each passageway;

an inlet communicating with the inlet passageway for introducing the primary fluid into the inlet passageway of said body; and an outlet communicating with the exhaust passageway to permit exhaust of the primary fluid from said body.

6. The cooler according to claim 5 wherein said heat exchange fluid is air.

7. The cooler according to claim 5 further comprising heat exchange fins extending into the passageways and exteriorly of the passageways to provide for heat transfer from the fluid to the surround medium.

8. The cooler according to claim 5 wherein said body is a longitudinal extrusion of constant cross section and wherein said cap means includes identical end plates for attachment to said extrusion for connecting the alternate ends of said passageways.

9. A cooler for fluids, comprising:

a body having an outer circumferential wall and an inner circumferential wall connected to the outer wall by passage walls to define a plurality of circumferentially spaced longitudinal passages, said passages including an inlet passage and an outlet passage separated by a plurality of intermediate passages, said passages being arranged to provide a heat exchange fluid gap between said inlet and outlet passages;

an end cap means for attachment to the opposed ends of said body for directing fluid through a continuous circuitous path from the inlet passage through the intermediate passages and to the outlet passage;

an inlet communicating with the inlet passage for introducing fluid into the inlet passage of said body; and an outlet communicating with the exhaust passage to permit exhaust of fluid from said body.

10. The cooler according to claim 9 further comprising heat exchange fins extending into the passages and exteriorly of the passages to provide for heat transfer from the fluid to the surround medium.

11. The cooler according to claim 9 wherein said body is a longitudinal extrusion of constant cross section and wherein said end cap means includes identical end plates for attachment to said extrusion for connecting the alternate ends of said passages.

12. A primary fluid cooler comprising:

a body having an outer circumferential wall and an inner circumferential wall connected to the outer wall by passage walls to define a plurality of circumferentially arranged longitudinal passages, said passages including an inlet passage and an outlet passage separated by a plurality of intermediate passages; and identical end caps for attachment to the opposite ends of said body for directing fluid through a continuous circuitous path from the inlet passage through the intermediate passages and to the outlet passage, said end caps having an externally communicating opening which serves as the inlet passage for introducing fluid into the inlet passage of the body in one of the caps and in the other of said caps serves as an outlet communicating with the exhaust passage to permit the exhaust of fluids from said body.

13. The cooler according to claim 12 wherein said end caps having an opening therethrough providing for the flow of a heat exchange fluid on an inner side of each passageway, thereby permitting the flow of heat exchange fluid on both an inner and an outer side of each passageway.

14. The cooler according to claim 13 further comprising heat exchange fins extending into the passages and exteriorly of the passages to provide for heat transfer from the fluid to the surround medium.

* * * * *